US008720245B2

(12) United States Patent
Spairani et al.

(10) Patent No.: US 8,720,245 B2
(45) Date of Patent: May 13, 2014

(54) SYSTEM FOR BENDING A METALLIC STRIP

(75) Inventors: Roberto Spairani, Mortara (IT); Secondo Spairani, Mortara (IT)

(73) Assignee: Pro Form S.R.L., Caravaggio (IT)

( * ) Notice: Subject to any disclaimer, the term of this patent is extended or adjusted under 35 U.S.C. 154(b) by 667 days.

(21) Appl. No.: 12/993,016

(22) PCT Filed: May 27, 2008

(86) PCT No.: PCT/IT2008/000348

§ 371 (c)(1),
(2), (4) Date: Dec. 30, 2010

(87) PCT Pub. No.: WO2009/144748

PCT Pub. Date: Dec. 3, 2009

(65) Prior Publication Data

US 2011/0107809 A1 May 12, 2011

(51) Int. Cl.
*B21D 11/00* (2006.01)

(52) U.S. Cl.
USPC ..... 72/307

(58) Field of Classification Search
USPC ..... 72/294, 307, 319, 387, 388
See application file for complete search history.

(56) References Cited

U.S. PATENT DOCUMENTS

| | | | | |
|---|---|---|---|---|
| 5,870,919 | A | 2/1999 | Song | |
| 6,629,442 | B2 * | 10/2003 | Park | 72/319 |
| 2002/0066299 | A1 | 6/2002 | Park | |
| 2006/0260377 | A1 | 11/2006 | Kane et al. | |
| 2006/0266091 | A1 | 11/2006 | Urabe | |

OTHER PUBLICATIONS

International Search Report for PCT/IT2008/000348, mailed Feb. 5, 2009.
Written Opinion of the International Searching Authority for PCT/IT2008/000348, mailed Feb. 5, 2009.

* cited by examiner

*Primary Examiner* — Teresa M Ekiert
(74) *Attorney, Agent, or Firm* — Nixon & Vanderhye, P.C.

(57) ABSTRACT

A device and a process are described for bending a metallic strip (W) by means of bending tools (3, 4) which can rotate around a common axis (M) near a guide aperture (1) through which the metallic strip to be bent is fed. Controllable blocking means (5-8) are provided to lock the bending tools in positions mutually alongside the guide aperture when they are in the rest condition, and to release at least one of the bending tools in the operating condition in which the bending is performed.

16 Claims, 5 Drawing Sheets

SYSTEM FOR BENDING A METALLIC STRIP

This application is the U.S. national phase of International Application No. PCT/IT2008/000348, filed 27 May 2008, which designated the U.S. the entire contents of which is hereby incorporated by reference.

FIELD OF THE INVENTION

The present invention concerns a system for bending a metallic strip and, in particular, a device and a process for the production of for die-cutting blades starting from a continuous metallic strip which is shaped via successive bending steps and undergoes a final shearing step.

BACKGROUND OF THE INVENTION

The devices known in the art for bending metallic strips, in particular those intended for the production of die-cutting blades, generally include a system for feeding the continuous metallic strip through a guide aperture, in the vicinity of which one or more bending tools are located. In the majority of cases two bending tools are provided, one to bend the strip to the right (or upwards, for example) and the other to bend the strip to the left (or downwards, for example).

The strip is fed forward through the guide aperture and temporarily stopped to perform the bending operation. The bending tool to be used is positioned near the guide aperture and then rotated to deform the strip as required to the right (or left) at a pre-set angle.

A bending system with two tools is described, for example, in U.S. Pat. No. 5,870,919, in which the bending tools are retractable tools engaged in appropriate seats of coaxial supporting elements and rotated around their common axis. The bending tools can be used in a mutually exclusive way, i.e. keeping one tool in the work position (extended) while the other is kept in the rest position (retracted) and vice versa.

Another example of a bending system with two tools is described in the U.S. Pat. No. 6,629,442, in which each tool is supported by a pair of coaxial supporting elements which can rotate around their common axis. The supporting elements of a pair are arranged alternately with those of the other pair and, consequently, at least two of them must have a seat for engagement of the bending tool supported, and a groove to permit the movement of the other one.

During the bending action, sliding occurs between the tool in contact with the strip and the strip itself. This results in considerable wear of the bending tools and therefore the need to replace the tools fairly frequently to ensure the necessary working accuracy.

It should also be remembered that during the bending step, the tool is subject to a stress which increases proportionally to the bending angle required. The effects of wear on the tool are therefore considerable if strips have to be produced with particularly narrow bending angles.

The known systems described above are particularly complex from the mechanical point of view and, consequently, replacement of the bending tools can be particularly time-consuming, thus affecting productivity.

Independently of the wear on the tools, the feed section of the strip, with the relative guide aperture, also has to be changed whenever starting a new production phase with a metallic strip with dimensions or shape different from that of the strip processed previously.

In general, the object of the present invention is to propose a device and a process for bending metallic strips which overcome the drawbacks of the known technique.

A particular object of the present invention is to propose a device of the type described above which is mechanically simple to produce.

A further object of the present invention is to propose a device of the type described above which makes the operations for replacing the bending tools and/or the strip feed section quick and easy.

SUMMARY OF THE INVENTION

These objects are achieved according to the invention by means of a device for bending a metallic strip and a relative bending process. Further peculiar aspects of the present invention are reported in the respective dependent claims.

According to a first aspect of the present invention, the device for bending a metallic strip includes at least one feed section to pass the strip through a guide aperture, at least one pair of bending tools which can rotate around at least one common rotation axis, and means for rotating the bending tools around the common rotation axis. The device advantageously includes controllable blocking means to lock the bending tools in positions mutually alongside the guide aperture when they are in the rest condition and to release at least one of the bending tools in the operating condition in which the bending is performed.

When in the rest condition, the tools are always near the guide aperture, positioned alongside the latter. This position, in addition to favouring rapid performance of the bending operation, is particularly suitable for replacement of the tools. In fact, when the tools have to be replaced, the blocking means can be set to release both the worn tools. The new tools can thus be easily positioned and, by setting the blocking means to the locking position, they are ready to proceed with the strip bending operations. The blocking means for locking and releasing the bending tools preferably include brackets that can be rotated around an axis perpendicular to the feed direction of the strip. The blocking means can be operated in various ways, for example by using pneumatic or electric actuators or similar.

To perform bending of the metallic strip, the bending tools are rotated by means which include controllable engagement members to engage or disengage the opposite ends of the bending tools.

The means for rotating the bending tools include in particular at least two hubs opposed with respect to the guide aperture; said hubs can rotate around an axis perpendicular to the feed direction of the strip.

The engagement members are housed in the hubs and are movable in translation along a direction parallel to the rotation axis of the hubs by means of pneumatic or electric actuators or similar. The engagement members move between a retracted position inside the hubs, and therefore disengaged from the bending tools, and a position in which they are extracted from the hubs, i.e. engaged with the ends of the bending tools.

In the bending systems of the known art, in particular in the systems with retractable tools, each tool must necessarily have a slim section throughout its insertion length, as it must fit between the strip being bent and the end of the feed section. The same applies to the known systems with tools engaged in grooves of the rotating supports, which must have a reduced section at the ends in order not to weaken the rotating supports with excessively wide grooves.

In the bending system according to the present invention, however, it is advantageously possible to use more hardy tools, i.e. tools with resistant section larger in the end portions which do not come into contact with the strip, while the portion that comes into contact with the strip can have a smaller section.

The simplicity of the solution proposed by the present invention furthermore allows one single motor to be used to simultaneously drive both the hubs.

When in the rest condition, the bending tools are locked in positions mutually alongside the guide aperture via the above-mentioned blocking means.

To perform a bending operation, the strip is moved forward through the feed section until a pre-set length emerges from the guide aperture.

After stopping the strip, the bending tool to be used is engaged at its ends by the engagement members which are appropriately extracted from the opposed hubs. In this way, the bending tool to be used rotates integrally with the opposed hubs in order to be rotated around the rotation axis common to both the tools.

The blocking means combined with the bending tool to be used are then operated to release it from its locking position, while the other tool is kept locked in the rest condition.

The bending tool to be used is then rotated by a rotation angle sufficient to bend the strip as required, and then re-set to the position corresponding to the rest condition. At this point, if the next bend is required in the same direction, the strip is moved forward again by a pre-set length and, once stopped, bending is performed by the same tool as illustrated previously.

If on the other hand the next bend is required in the opposite direction, the tool which has already performed the bend is locked in the rest position by the respective blocking means and the respective engagement members are re-set to the retracted position inside the hubs, so as to disengage the tool that has just performed the bending operation from the rotation drive means. The next bend, in the opposite direction to the previous one, will therefore be performed by the other tool following the steps described previously.

During the bending operations, each tool is activated in a mutually exclusive manner. Nevertheless, this does not exclude the possibility of operating both the tools simultaneously, for example if the strip is sheared by means of repeated bending in both directions, if necessary also exploiting a cut-off line previously provided in the strip.

BRIEF DESCRIPTION OF THE DRAWINGS

Further characteristics and advantages of the present invention will become more evident from the following description, provided by way of example with reference to the accompanying drawings, in which.

MODES FOR CARRYING OUT THE INVENTION

Figure 1:
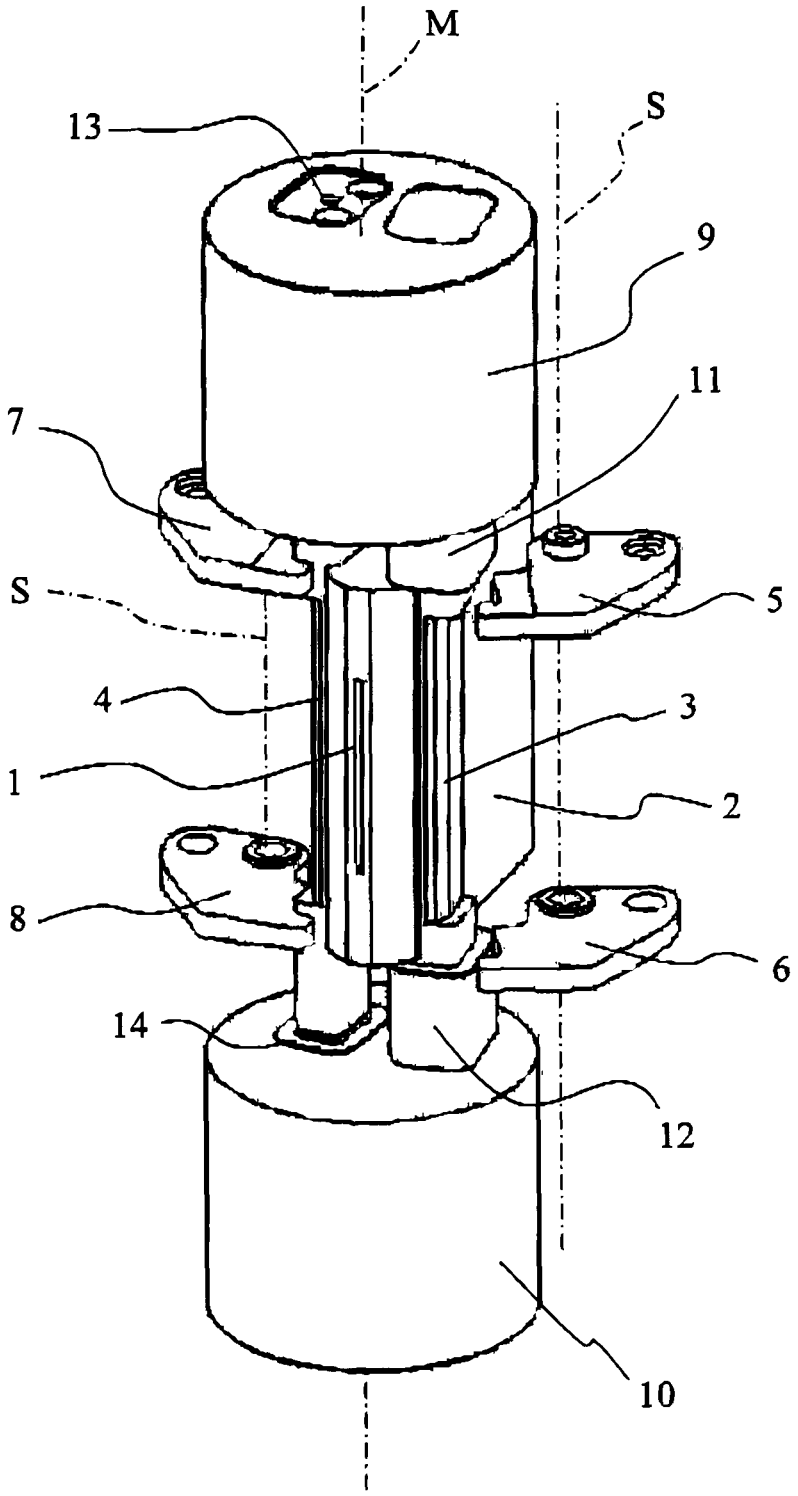
FIG. 1 is a perspective schematic view of a possible embodiment of the device according to the present invention.

With reference first to FIG. 1, the device for bending metallic strips according to the invention is illustrated as it is about to perform the bending operation in one of the two directions.

The device includes a guide aperture 1 positioned vertically and arranged at the end of the feed section 2 via which the strip to be processed (not shown) is fed forward to the point where the bend is required and temporarily locked during the bending step. Although FIG. 1 illustrates a configuration of the device in which the guide aperture 1 and the feed section 2 are oriented in a vertical direction, the device can be installed with guide aperture oriented in a horizontal direction.

The bending tools 3 and 4 are retained alongside the guide aperture 1 by means of four brackets 5, 6, 7 and 8, two for each tool, which can rotate around axes S perpendicular to the feed direction of the strip. The brackets 5-8 are movable in pairs between a position in which the tools 3 and 4 are retained in position alongside the guide aperture 1 and a position in which the bending tools are released, for example during the bending phases or during their replacement.

In FIG. 1, by way of example, the brackets 7 and 8 are in the position for locking the tool 4 beside the guide aperture 1, while the brackets 5 and 6 are in the position for release of the tool 3.

Rotation of the brackets 5, 6, 7 and 8 is preferably performed, when required, by means of pneumatic actuators or, alternatively, by means of electric or electromechanical actuators or the like.

The means for rotating the tools 3 and 4 include a lower hub 9 and an upper hub 10, arranged in opposite positions with respect to the predominant length of the guide aperture 1, which can rotate in a synchronised manner around their common axis M perpendicular to the feed direction of the strip.

To engage or disengage rotation of the tools 3 and 4, each of the hubs 9 and 10 houses engagement members 11, 12, 13 and 14 which translate in a direction parallel to the axis of rotation of the hubs.

The movement of the engagement members 11-14 is also performed preferably by means of pneumatic actuators or, alternatively, by means of electric or electromechanical actuators or the like. The engagement members move between a tool disengagement position, in which the relative engagement members are retracted inside the hubs, and a tool engagement position, in which the respective engagement members are extracted from the hubs.

By way of example, again with reference to FIG. 1, the engagement members 11 and 12 for the tool 3 are in the extracted position and thus engage the ends of the tool 3 permitting rotation by the hubs 9 and 10, while the engagement members 13 and 14 for the tool 4 are in the disengaged position, retracted inside the hubs 9 and 10, thus avoiding rotation of the tool 4.

Figure 2A:
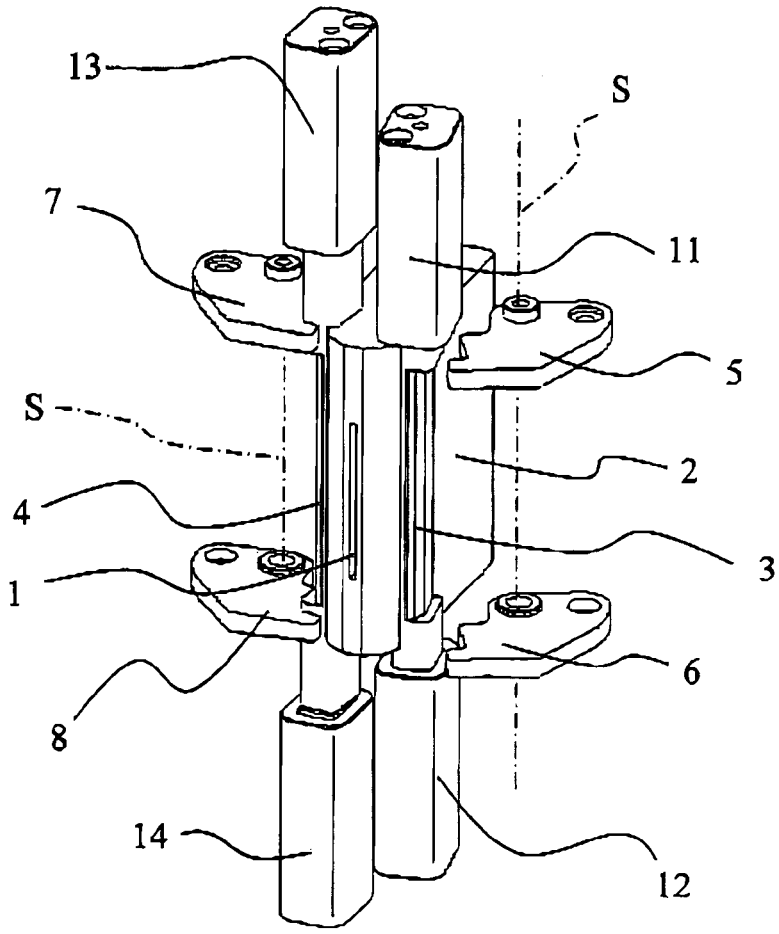
FIG. 2A is a view of the device of FIG. 1 without the hubs.

FIG. 2A shows a detail of the device of FIG. 1 without the hubs 9 and 10 to illustrate more clearly the engagement members 11, 12, 13 and 14 in the same engagement and disengagement conditions as just described, i.e. with the engagement members 11 and 12 engaging the ends of the tool 3, while the ends of the tool 4 are disengaged from the engagement members 13 and 14.

Figure 2B:
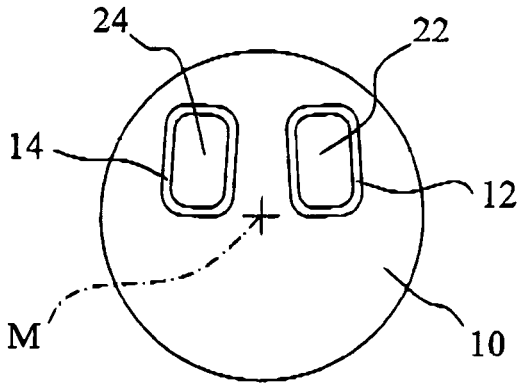
FIG. 2B is a plan view of one of the two hubs of the device of FIG. 1.

The view of FIG. 2B, which is a top plan view of the lower hub 10, shows the engagement members 12 and 14 and the respective seats 22 and 24 in which the lower ends of the tools 3 and 4 are engaged respectively.

At this point of the description, it will be clear that in order for the strip passing through the feed section 2 of the guide aperture 1 to be processed, the tool to be used, according to whether the strip has to be bent to the right or the left, must be engaged by the corresponding engagement members to rotate and therefore necessarily be disengaged from the corresponding brackets, which will be rotated towards the outside of the device, so as to release the bending tool from the position alongside the guide aperture where it is retained while at rest.

The engagement members 11, 12, 13 and 14 in the extracted position allow transmission of the rotation imparted by the motor to the hubs 9 and 10 to the tools 3 or 4 engaging the bending tool at their ends before it is released from the respective brackets 5, 6 or 7, 8 by means of rotation of the latter outwards.

When the engagement members 11, 12, 13 and 14 are retracted inside the respective housings obtained in the hubs 9 and 10, the tools 3 and 4 are retained at the level of the guide aperture 1 by the brackets 5, 6, 7 and 8 and do not receive the rotation of the hubs since they are completely disengaged from them.

With the device in this configuration, i.e. at rest, it is possible to easily replace the tools 3 and 4 without having to disassemble mechanical parts, by simply operating the actuators for rotation of the brackets. Removal of the tools 3 and 4 furthermore facilitates replacement of the feed section 2 if it is worn or if it has to be replaced according to the height of the strip to be processed subsequently.

Figure 4:
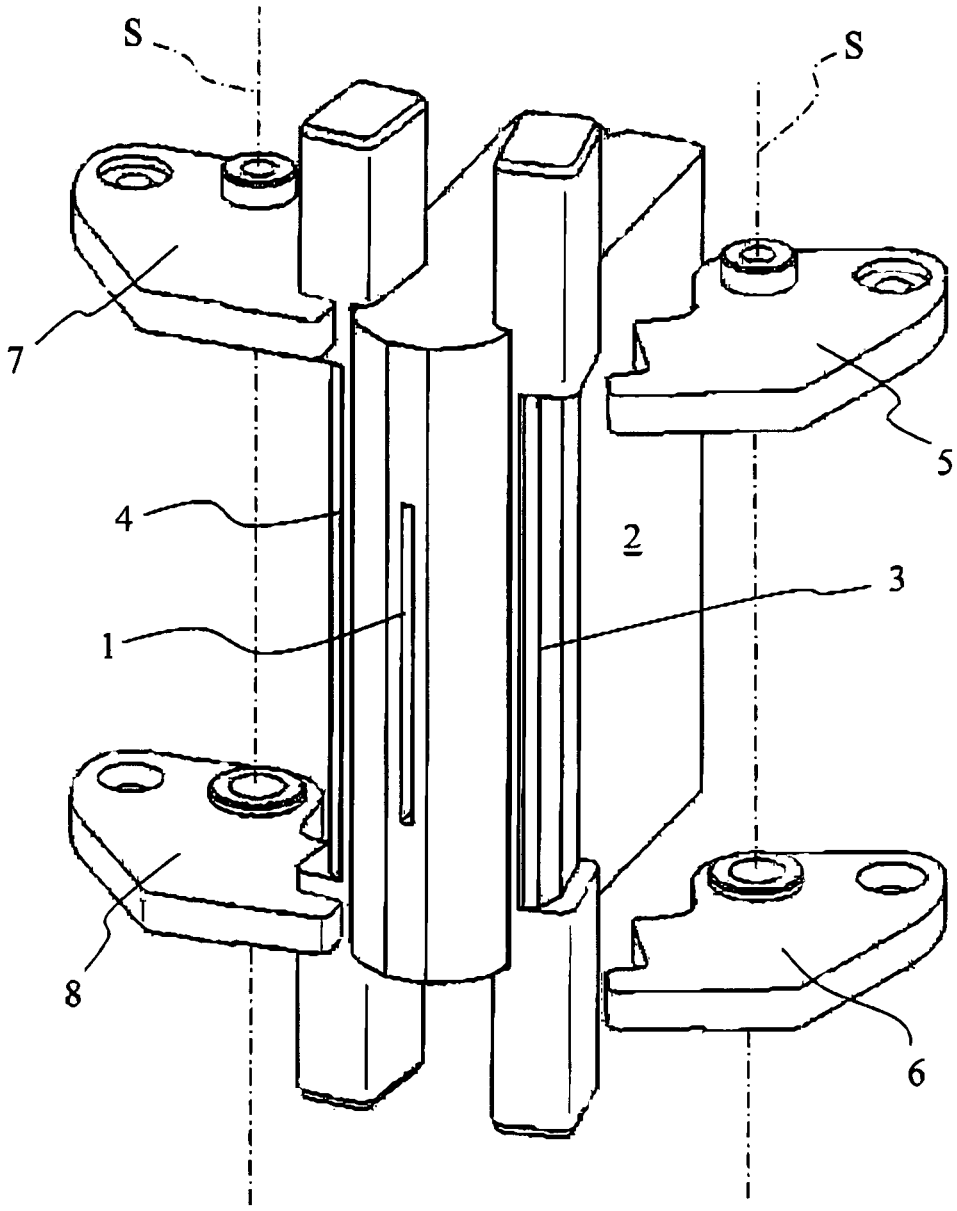
FIG. 4 shows a detail of the device without the hubs and engagement members.

Outward rotation of the brackets 5, 6, 7 and 8, corresponding to the tool to be replaced, allows it to be released from the guide aperture 1 since the corresponding engagement members do not engage its ends, as they are retracted in their respective housings obtained in the hubs. FIG. 4 shows the detail of the two tools 3 and 4 with the ends free of the engagement members, not shown for the sake of visual simplicity: the brackets 7 and 8 are closed, thus maintaining the tool 4 alongside the guide aperture 1, while the brackets 5 and 6 are in the open position, rotated towards the outside in order to completely release the tool 3 which can be easily replaced.

The steps of bending the metallic strip by means of the present device include passing the strip through the guide aperture 1 and into its feed section 2 of suitable dimensions in relation to the thickness and size of the strip to be processed, sliding the latter to the point where the bend is required and temporary locking of the same during the actual bending operations. Said operations are performed by engaging the appropriate tool, according to whether the bend is required to the right or left, by means of the engagement members 11, 12, 13 and 14, opening the corresponding brackets and performing synchronised rotation of the hubs 9 and 10 at the required angle. Once the bending operation has been performed, the hubs rotate and return, to their starting position and the strip is moved to the next point to be bent. If the next bend is required in the same direction as the previous one, the tool just used, still connected, is rotated again at the required angle, otherwise it is released, withdrawing the corresponding engagement members into the housings on the two hubs and closing the corresponding brackets; the other tool is then connected, extracting the corresponding engagement members and opening the relative brackets. The bends are performed successively according to the profile to be given to the strip.

For example, starting from the condition illustrated in FIG. 1 in which the tool 3 is the bending tool to be used, it can be seen that the tool 3 is engaged, the engagement members 11 and 12 being extracted respectively from the hubs 9 and 10, and the brackets 5 and 6 are in the open position after being rotated towards the outside of the device around their axis S.

The tool 4, on the other hand, is disengaged as the engagement members 13 and 14 are retracted respectively in the hubs 10 and 9 and is positioned alongside the guide aperture 1 by means of the brackets 7 and 8 which are in the closed position.

Figure 3B:
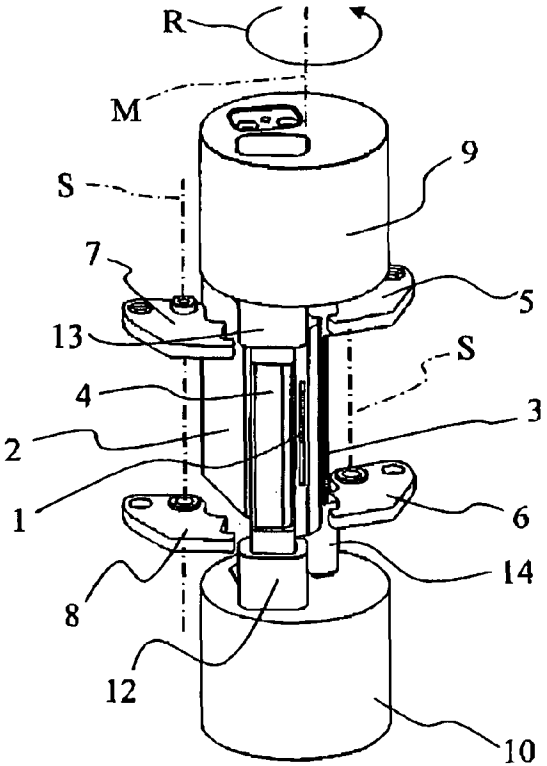
FIGS. 3A and 3B are views of the device of FIG. 1 during bending, in one direction and in the opposite direction respectively.
Figure 3A:
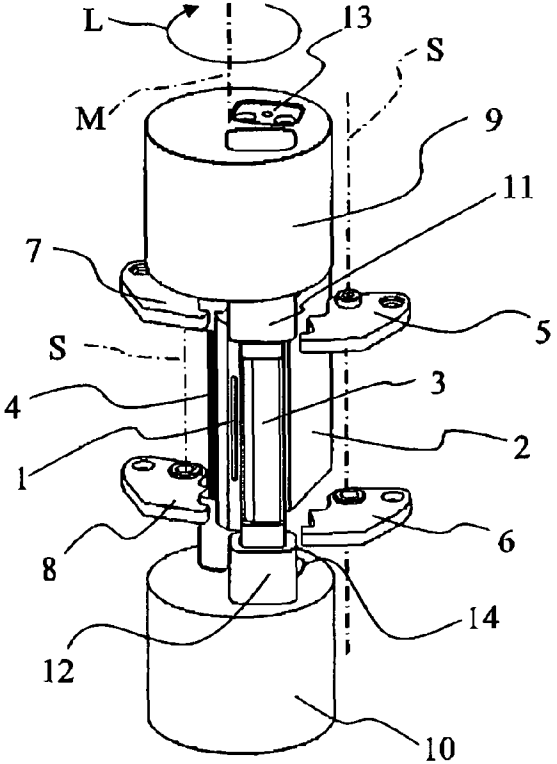

Bending is then performed with the tool 3 as illustrated in FIG. 3A, with the hubs 9 and 10 rotating around the common axis M by the required angle in the direction indicated by the arrow L, and the tool 3 rotating integrally with the hubs 9 and 10 by means of the engagement members 11 and 12. The tool 4, being disengaged from the hubs 9 and 10, remains positioned alongside the guide aperture 1. Once bending has been performed, the hubs 9 and 10 rotate in the opposite direction to the one indicated by the arrow L in FIG. 3A, returning to the rest position illustrated in FIG. 1. At this point, if another bend has to be made in the same direction, the strip is moved forward again until it emerges from the guide aperture 1 for the required length, and the tool 3 is rotated again.

Figure 5:
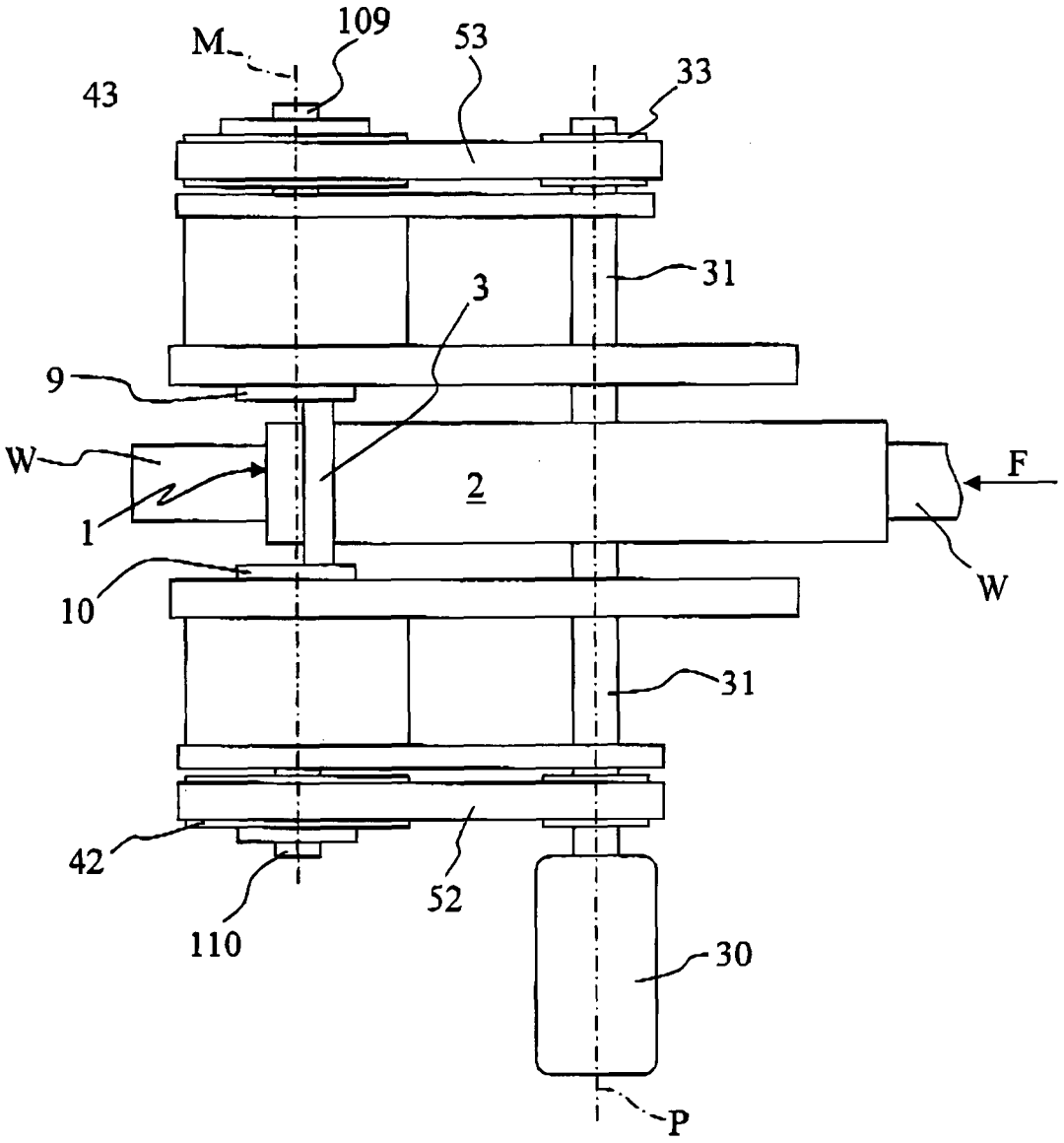
FIG. 5 is a lateral schematic view illustrating some components of the device according to the present invention.

If on the other hand the bend has to be made in the opposite direction with respect to the previous one for which the tool 3 was used, the latter must be locked by the brackets 5 and 6 rotated towards the inside by means of an actuator, so that the tool 3 remains locked in position alongside the guide aperture 1 when disengagement occurs by retraction of the engagement members 11 and 12 into the hubs 9 and 10. The engagement members 13 and 14 are then extracted to engage the ends of the tool 4 to be used in the next bend, and the brackets 7 and 8 are opened by outward rotation of the device. After moving the strip forward for the required length, rotation of the hubs 9 and 10 begins around the common axis M in the direction indicated by the arrow R of FIG. 3B, until completion of the rotation to the required angle. FIG. 5 shows schematically a possible embodiment of the rotation system of the bending tools 3 and 4 for the metallic strip W which is passed through the feed section 2 in the direction of the arrow F until it emerges from the guide aperture 1. The system is provided with one single motor 30, for example a gearmotor with shaft 31 on which the pulleys 32 and 33 are fitted. The shaft 31 rotates around an axis P, parallel to the axis M, which is obviously offset with respect to the feed section of the strip W.

The hubs 9 and 10 are connected to respective shafts 109 and 110, with rotation axes coinciding with the axis M, on which the pulleys 42 and 43 are fitted. Synchronised transmission of the movement to the two hubs is provided for example by means of a first timing belt 52 stretched between the pulleys 32 and 42 and a second timing belt 53 stretched between the pulleys 33 and 43.

Other means for transmission of the movement can be used just as effectively between the shaft 31 and the shafts 109 and 110, for example gear transmission means or the like.

The invention claimed is:

1. A device for bending a metallic strip, including at least one feed section to pass said strip through a guide aperture, at least one pair of bending tools which can be rotated around at least one common rotation axis, and means for rotating said bending tools around said at least one common rotation axis, said device including controllable blocking means to lock said bending tools mutually alongside said guide aperture when they are in the rest condition and to release at least one of said bending tools to the operating condition in which the bending is performed, wherein said means for rotating said bending tools include controllable engagement members to engage or disengage the opposite ends of said tools, and wherein said engagement members are housed in hubs and translate in a direction parallel to a rotation axis of said hubs between a retracted position inside said hubs, in the disengaged condition from said bending tools, and a position extracted from said hubs, in the engaged condition with said bending tools.

2. The device as claimed in claim 1, wherein said blocking means to lock and release said bending tools include brackets which can be rotated around an axis perpendicular to the feed direction of said strip.

3. The device as claimed in claim 1, wherein hubs are opposed with respect to said guide aperture and are adapted to rotate around said axis, perpendicular to the feed direction of said strip.

4. The device as claimed in claim 3, wherein said hubs are simultaneously rotated by one single motor.

5. A machine for the production of die-cutting blades starting from a continuous metallic strip which is shaped by means of successive bending steps and undergoes a final shearing step, including a device as claimed in claim 1, and wherein said guide aperture in said feed section is oriented in a horizontal direction.

6. A machine for the production of die-cutting blades starting from a continuous metallic strip which is shaped by means of successive bending steps and undergoes a final shearing step, including a device as claimed in claim 1, and wherein said guide aperture in said feed section is oriented in a vertical direction.

7. A process for bending a metallic strip, wherein said strip is passed through a feed section to a guide aperture and wherein said strip is bent by means of at least one pair of bending tools positioned near said guide aperture and which can be rotated around at least one common rotation axis, the method including:

i) at the rest condition, keeping said tools locked in position mutually alongside said guide aperture by means of controllable blocking means;

ii) engaging at least one first of said bending tools at its ends to make it integral with means for rotating said bending tools around said at least one common rotation axis, wherein said means for rotating said bending tools include controllable engagement members to engage or disengage the opposite ends of said tools, and wherein said engagement members are housed in hubs and translate in a direction parallel to the rotation axis of said hubs between a retracted position inside said hubs, in the disengaged condition from said bending tools, and a position extracted from said hubs, in the engaged condition with said bending tools;

iii) operating said blocking means associated with said first tool to release it from its locking position while the second of said bending tools is blocked in its rest position;

iv) rotating said first tool by a rotation angle sufficient to give said strip the required bend; and v) re-setting said first tool to its rest position.

8. The process as claimed in claim 7 wherein, before said rotating, said strip is moved forward through said feed section until it emerges from said guide aperture for a pre-set length.

9. The process as claimed in claim 7 wherein, after said re-setting, the following are provided:

vi) operating the blocking means associated with said first tool to re-lock it in its rest position; and vii) disengaging said first bending tool from said rotation means.

10. The process as claimed in claim 7, wherein, after said re-setting, said strip is moved forward again for a pre-set length and the process re-starts from said step iv).

11. A device for bending a metallic strip, including at least one feed section to pass said strip through a guide aperture, at least one pair of bending tools around at least one common rotation axis, said device including a controllable lock to lock said bending tools mutually alongside said guide aperture when they are in the rest condition and to release at least one of said bending tools to the operating condition in which the bending is performed, controllable engagement members to engage or disengage the opposite ends of said tools, and wherein said engagement members are housed in hubs and translate in a direction parallel to a rotation axis of said hubs between a retracted position inside said hubs, in the disengaged condition from said bending tools, and a position extracted from said hubs, in the engaged condition with said bending tools.

12. The device as claimed in claim 11, wherein lock includes brackets which can be rotated around an axis perpendicular to the feed direction of said strip.

13. The device as claimed in claim 11, wherein hubs are opposed with respect to said guide aperture and are adapted to rotate around said axis, perpendicular to the feed direction of said strip.

14. The device as claimed in claim 13, wherein said hubs are simultaneously rotated by one single motor.

15. A machine for the production of die-cutting blades starting from a continuous metallic strip which is shaped by means of successive bending steps and undergoes a final shearing step, including a device as claimed in claim 11, and wherein said guide aperture in said feed section is oriented in a horizontal direction.

16. A machine for the production of die-cutting blades starting from a continuous metallic strip which is shaped by means of successive bending steps and undergoes a final shearing step, including a device as claimed in claim 11, and wherein said guide aperture in said feed section is oriented in a vertical direction.

* * * * *